United States Patent [19]

Kim

[11] 4,254,783

[45] Mar. 10, 1981

[54] HAIR PIECE HAVING A COMB-SHAPED ATTACHING MEMBER

[76] Inventor: Sang J. Kim, 1 Campbell Ave., SW., Roanoke, Va. 24011

[21] Appl. No.: 891,646

[22] Filed: Mar. 30, 1978

[51] Int. Cl.[3] ..... A45D 24/00

[52] U.S. Cl. ..... 132/11 R; 132/53

[58] Field of Search ..... 132/11 R, 105, 162, 132/143

[56] References Cited

U.S. PATENT DOCUMENTS

| | | | |
|---|---|---|---|
| 794,479 | 7/1905 | Austin | 132/106 X |
| 1,346,718 | 7/1920 | Muller | 132/53 |
| 1,714,358 | 5/1929 | Finkelstein | 132/53 |
| 2,792,007 | 5/1957 | Parmer | 132/162 |
| 3,566,889 | 3/1971 | Cole | 132/53 |
| 3,750,680 | 8/1973 | Miller | 132/11 R |
| 3,896,821 | 7/1975 | Clark | 132/5 |

*Primary Examiner*—G. E. McNeill

*Attorney, Agent, or Firm*—Sixbey, Friedman & Leedom

[57] ABSTRACT

A hair piece having a comb-shaped attaching member designed to provide the most natural appearance while also securely attaching the hair piece to the natural hair of the hair piece wearer. In the preferred embodiment, artificial hair roots are attached to the comb-shaped member at a plurality of evenly dispersed and disconnected hair root attaching sites formed on one side of the comb-shaped member. To provide the desired flexibility, the comb-shaped member may be formed with a spring wire core coated with a thermoplastic material which also serves to anchor the artificial hair roots.

1 Claim, 3 Drawing Figures

Fig. 1
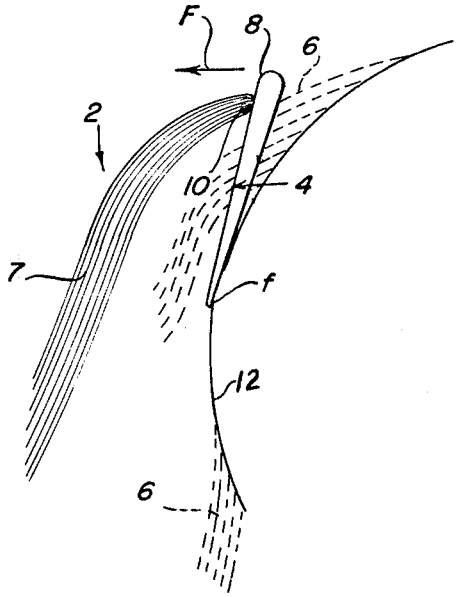
Fig. 2
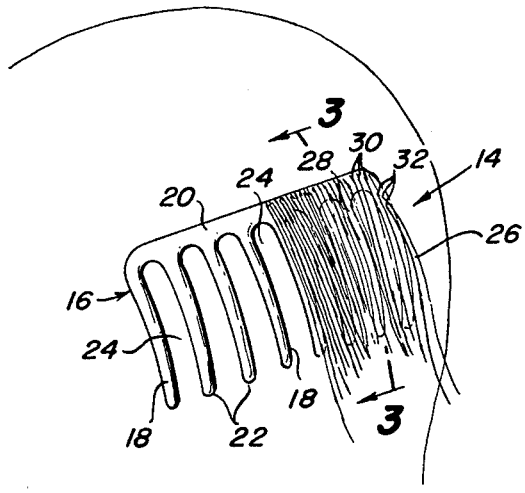
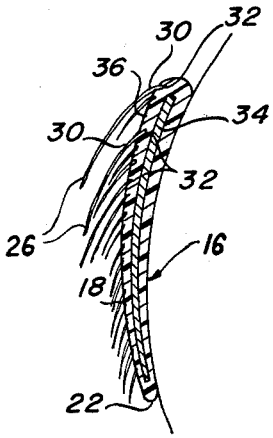
Fig. 3

HAIR PIECE HAVING A COMB-SHAPED ATTACHING MEMBER

BACKGROUND OF THE INVENTION (1) Field of the Invention

This invention relates to artificial hair pieces including means connected with the hair piece for securing the hair piece to the wearer's natural hair.

(2) Discussion of the Prior Art

Concern over personal appearance is a virtually universal trait of humans with the style and appearance of hair being an especially important aspect of this concern. Artificial hair pieces have, accordingly, become extremely popular not only to aid those interested in the capacity to change the appearance of their hair, but also to serve as a substitute for hair which may have been lost due to baldness. Unfortunately, a truly effective and convenient technique for attaching hair or hair pieces has not been disclosed in spite of great efforts to satisfy the demand therefor. Such efforts have resulted in exotic techniques including hair transplants and surgically implanted hair piece anchors, but these costly and inconvenient solutions are obviously not the answer for most individuals.

On the more practical side, it has been proposed to attach a hair piece by utilizing existing natural hair to anchor the artificial hair by first attaching the artificial hair to a comb-like structure such as illustrated in French Pat. No. 421,964 and U.S. Pat. Nos. 1,346,718; 1,390,778 and 1,714,359. The tangs of such comb structures can thus be used to frictionally engage the existing natural hair of the wearer to anchor the hair piece in place. As convenient as such structure may be, this approach still suffers from some disadvantages. For example, the artificial hair roots disclosed in the above cited prior art are connected to the comb structure adjacent the base of the comb tangs thus concentrating the hair roots along the base of the comb. As a result, any forces generated either by the weight of the artificial hair itself or by outside forces applied to the strands of artificial hair will cause a net force on the comb tending to pull the tangs of the comb free from the existing natural hair by rotating the comb about a pivot point formed by the free ends of the comb tangs. The French patent (421,964) alleviates this problem to some degree by attaching some hair roots to the base portions of each tang as well as to the base portion of the comb structure interconnecting the comb tangs. However, the hair roots are still concentrated near the base portion of the comb resulting in a concentration of those forces which would tend to pull the hair piece free from the natural hair with which the comb is anchored. Moreover, the French patent discloses attachment of clumps of artificial hair roots to the comb structure by preforming apertures in the comb followed by the step of securing the hair roots in the preformed apertures. This approach for mounting individual hair roots is tedious and costly and unduly weakens the comb tangs.

U.S. Pat. No. 3,628,546 discloses a hair attaching structure wherein the roots of the artificial hair is attached along an undulating wire-like frame. In the device disclosed by this patent, natural hair engaging tangs are arranged generally perpendicularly with respect to the orientation of the straight sections of the undulating wire frame, thus making it extremely difficult for the straight sections of the undulating wire frame to guide natural hair into the space between the straight sections so as to frictionally engage the natural hair. No satisfactory solution has thus been devised to form a particularly effective structure for conveniently attaching a hair piece to existing natural hair.

SUMMARY OF THE INVENTION

It is an object of this invention to overcome the deficiencies of the prior art as indicated above. In particular, it is an object of this invention to provide a very simple, easily applied hair piece attaching structure which is adapted to more securely attach a hair piece to the wearer's natural hair than has been possible heretofore.

It is a more specific object of this invention to provide a hair piece including a comb shaped member having a plurality of elongated tangs to which are secured the roots of a plurality of strands of artificial hair at a plurality of physically spaced hair root attaching sites evenly dispersed over one side of the comb shaped member. The hair roots at each hair root attaching site are physically spaced from and are out of contact with the hair roots at all other remaining hair root attaching sites, thereby approximately the dispersed nature of natural hair roots on a human being.

Yet another object of this invention is to provide a hair piece including a comb shaped member having a plurality of elongated tangs and a comb bridging means for interconnecting and positioning the elongated tangs in spaced apart parallel orientation to frictionally engage the natural hair by guiding the natural hair into the spaces between the tangs as the free ends of the tangs are moved into the natural hair of the hair piece wearer. The hair root attaching sites referred to above are evenly dispersed over one side of the comb bridging means as well as over one side of each elongaged tang. The density of hair root attaching sites on each tang is increased over the density of such sites on the comb bridging means by an amount proportional to the space between each tang and the next adjacent tang so that the overall density of hair roots within the area defined by the perimeter of the comb shaped member is as relatively constant as is reasonably possible.

It is an additional object of this invention to provide a hair piece as described above including tangs which may range from relatively rigid to semi-flexible but considerably stiffer than the strands of artificial hair to which the tangs are attached. In particular the tangs may be formed with a spring-like metallic core coated with a thermoplastic material such that the individual hair roots may be embedded and secured to the tangs by heating the thermoplastic material so that the roots may be inserted therein followed by the step of cooling the thermoplastic materials so as to lock the hair roots in place.

Other and more specific objects of the subject invention will become apparent from a consideration of the drawings and description of the preferred embodiment.

SUMMARY OF THE DRAWINGS

FIG. 1 is a fragmentary side elevational view of a prior art hair piece including a comb-like attaching means positioned so as to engage the natural hair of a hair piece wearer, FIG. 2 is a perspective view of a hair piece designed in accordance with the subject invention, and FIG. 3 is a cross-sectional view of the hair piece illustrated in FIG. 2 taken along lines 3—3.

DESCRIPTION OF THE PREFERRED EMBODIMENT

FIG. 1 illustrates a conventional hair piece with an attaching comb structure adapted to frictionally engage the natural hair 6 (illustrated in dashed lines) of a wearer of the hair piece 2. The artificial hair 7, which may be either real or synthetic hair, is attached at its roots to the base 8 of the comb structure 4. This method of attachment suffers two significant drawbacks. In particular, an unnatural appearance is created by having all of the hair roots lumped together into intimate contact with one another as illustrated at 10 in FIG. 1. Moreover, any forces which may be imparted to the artificial hair 7 tend to create a net force component F acting generally at the base 8 of comb structure 4 to cause the comb structure to rotate about a pivot point located at the point at which the comb structure engages the wearer's head 12 (illustrated in fragmentary view). As the comb structure begins to move away from the wearer's head, a pivot point f is formed at the extremities of the comb tangs thus producing the maximum possible lever arm at which the force F can operate to further rotate the comb structure 4 about the pivot point f. Obviously, this arangement can create an unstable structure resulting in the likelihood that the hair piece 2 will become dislodged from the wearer's head.

FIG. 2 discloses an embodiment of the subject invention disclosing a hair piece 14 formed from a comb shaped member 16 including a plurality of elongated tangs 18 interconnected by comb bridging means 20. The elongated tangs 18 are connected at their base to the comb bridging means 20 in spaced apart parallel orientation. The free extremities 22 of the tangs are tapered or rounded so as to assist in guiding the natural hair into the spaces 24 between tangs 18. Plural strands of artificial hair 26, which may be either real human hair or synthetic hair, are attached to the comb shaped member by hair root securing means 28. For purposes of illustration, the artificial hair 26 is shown attached only to one section of the comb shaped member 16 although in practice hair would be attached to one entire surface of the comb shaped member.

The hair roots securing means 28, which may be in the form of a thermoplastic material, is designed to secure the roots 30 of each strand of hair 26 to the comb shaped member 16 at a plurality of physically spaced hair root attaching sites 32 which are evenly dispersed over one entire side of the comb shaped member 16. The hair roots 30 located at each hair root attaching site 32 are physically spaced from and are out of contact with the hair roots attached at all other hair root attaching sites 32. By this arrangement, the hair roots are dispersed over one side of a comb shaped member 16 as defined by the perimeter of the member. To achieve the most uniform dispersion of hair roots possible, the density of hair root attaching sites along each tang 18 is greater than the density of hair roots attached to the comb bridging means 20 in the same ratio as the surface of a tang 18 compared with the surface space separating the tang from the next adjacent tang.

It is possible to attach more than one hair root at each hair root attaching site 32. A representative range would be 1 to 20 although it is preferred to use only two or three hairs at each hair root attaching site 32 in order to achieve the most natural correspondence to the dispersion of hair root on a normal human head. In particular, the density of hair roots per square inch is desirably within a range of 200 to 1000. As illustrated in FIG. 2, and more clearly in FIG. 3, the individual tangs 18 may be slightly curved so as to approximate the radius of curvature of a human head and thereby allow the comb shaped member 16 to lie more closely to the scalp of the wearer.

Referring now to the cross-sectional view of FIG. 3, the comb shaped member 16 is illustrated as being formed of a metallic core or frame 34 formed of metal designed to provide a desired degree of stiffness yet flexibility to the tangs of the comb shaped member 16. A thermoplastic material 36 is coated on the outer surface of frame 34 so as to form the hair root securing means. Thus the hair roots 30 may be attached at the hair root attaching sites 32 by first heating the thermoplastic material and inserting the hair roots therein followed by the step of cooling the thermoplasic material so as to permanently embed the hair roots within the thermoplastic coating 36. It is also possible to form the comb shaped member entirely out of thermoplastic material. If the thermoplastic material is stiff, a very soft plastic sheet into which the hair roots are anchored may be attached to one side of the comb member. The degree of flexibility of the various tangs 18 is somewhat a matter of design choice although the tang 18 should certainly be stiffer than the strands of hair 26.

In FIG. 3 the hair roots 30 are attached to the comb shaped member 16 at an acute angle with respect to the outer surface of the comb shaped member. In fact the hair roots are oriented toward the free end 22 of the tangs and are generally arranged in a plane perpendicular to the outer surface of the comb shaped member 16 wherein the plane passes through the longitudinal axis of the tan 18 with which these respective hair roots are associated.

One important advantage of the disclosure structure is that by dispersin the hair roots along the entire length of each tang of the comb shaped member 16, it is possible to exert force on respective artificial hair strands 26 without imparting a component of force which tends to rotate the comb about the free extremities 22 of the tangs such as happens with the prior art construction illustrated in FIG. 1. In particular, those strands which are connected near the free extremities of each tang will tend to pull the comb shaped member 16 in a direction so as to further engage the comb tangs with the natural hair of the wearer and thus return the comb shaped member 16 to a position wherein it is able to fully engage the natural hair of the wearer and thus obtain the maximum possible degree of frictional engagement therewith.

The comb bridging means 20 may take the form of a plurality of U-shaped bends attached to the ends of alternate tangs to form a continuous zig-zag or undulating comb-like structure to which the artificial hair may be attached.

Other and more specific objects of the subject invention are apparent from a consideration of the above description of the preferred embodiment.

I claim:

1. A hairpiece for attaching natural looking artificial hair to existing hair, comprising (a) anchoring means for frictionally engaging the natural hair by subdividing the natural hair into groups of generally elongated hair strands, said anchoring means including a comb shaped member having a plurality of semiflexible elongated tangs which are considerably stiffer than the artificial hair and a comb bridging means for interconnecting and positioning said elongated tangs in spaced apart parallel orientation to frictionally engage the natural hair by guiding the natural hair into the spaces between said tangs as the free ends of said tangs are moved into the natural hair, said tangs including a metallic core and a thermoplastic material coated over the entire surface of said metallic core;

(b) a plurality of strands of artificial hair, each said strand having a hair root, and (c) hair root securing means for securing the roots of each said strand to said comb shaped member at a plurality of physically spaced hair root attaching sites evenly dispersed over the entire surface of one side of said comb shaped member including the entire surface of said comb bridging means and the entire surface of each and every tang on one side of said comb shaped member to approximate the dispersal of natural hair at a surface density of from 200 to 1000 hair roots per square inches, wherein the density of hair root attaching sites on each said tang is increased over the density of said hair root attaching sites on said comb bridging means by an amount proportional to the space between each said tang and the next adjacent tang to cause the overall density of hair roots within the area defined by the perimeter of said comb shaped member to be relatively constant, said hair roots at each said hair root attaching site being physically spaced from and out of contact with said hair roots attached at all remaining hair root attaching sites, said hair roots attached to said tangs being embedded solely in said thermoplastic material, whereby comb removing forces exerted on said strands of artificial hair attached by said hair root securing means to the free ends of said tangs will tend to pull the comb shaped member in a direction to further engage the comb tangs with the natural hair of the wearer.

* * * * *